US007488040B2

(12) United States Patent
Dozsa-Farkas

(10) Patent No.: US 7,488,040 B2
(45) Date of Patent: Feb. 10, 2009

(54) SERVO MECHANISM FOR A SEAT PART, IN PARTICULAR OF A CHAIR

(75) Inventor: Andras Dozsa-Farkas, München (DE)

(73) Assignee: OMP S.R.L, Castello Di Godego (IT)

( * ) Notice: Subject to any disclaimer, the term of this patent is extended or adjusted under 35 U.S.C. 154(b) by 0 days.

(21) Appl. No.: 11/969,490

(22) Filed: Jan. 4, 2008

(65) Prior Publication Data

US 2008/0164746 A1 Jul. 10, 2008

(30) Foreign Application Priority Data

Jan. 5, 2007 (DE) ..... 10 2007 001 194

(51) Int. Cl.
*A47C 1/032* (2006.01)

(52) U.S. Cl. ..... 297/317; 297/318; 297/322; 297/300.5

(58) Field of Classification Search ..... 297/68, 297/69, 284.11, 300.1, 300.2, 300.5, 337, 297/423.36
See application file for complete search history.

(56) References Cited

U.S. PATENT DOCUMENTS 426,602 A * 4/1890 Muhl ..... 297/68
953,872 A * 4/1910 Vrba ..... 297/90
3,554,599 A * 1/1971 Pietschmann ..... 297/353
3,883,173 A * 5/1975 Shephard et al. ..... 297/312
4,773,703 A * 9/1988 Krugener et al. ..... 297/284.1
5,380,063 A * 1/1995 Dauphin ..... 297/284.11
5,782,535 A * 7/1998 Lafer ..... 297/423.36
6,375,261 B1 * 4/2002 Link ..... 297/284.11
6,601,918 B2 * 8/2003 Mattsson ..... 297/284.11
7,108,322 B2 * 9/2006 Erker ..... 297/284.11
2006/0244294 A1 11/2006 Dozsa-Farkas

* cited by examiner

*Primary Examiner*—Peter R. Brown
(74) *Attorney, Agent, or Firm*—Henry M. Feiereisen; Ursula B. Day

(57) ABSTRACT

A servo mechanism for a seat part arranged on a support frame for travel in a longitudinal direction in synchronism with an adjustment of a back rest part from a normal position to several predetermined reclined positions, includes a scissor-type articulated lever assembly which is connected to the seat part and the support frame. The articulated lever assembly includes several articulated lever elements. A spring assembly progressively applies a spring force upon the scissor-type articulated lever assembly such that a relative change in angular disposition between the lever elements applies a substantially constant force upon the seat part in every position of the seat part, whereby a relatively great longitudinal travel distance of the seat part is accompanied by a short spring travel during the spring force application.

12 Claims, 7 Drawing Sheets

38
5
38a
6
7
9
35
36
34
18
33
A
B
31
32
14
30
29
38b
39
40
2
15

39
B
38b'
38b'
30'
38'
38'
38a'
38a'
37'
37'
32'
38'

SERVO MECHANISM FOR A SEAT PART, IN PARTICULAR OF A CHAIR

CROSS-REFERENCES TO RELATED APPLICATIONS

This application claims the priority of German Patent Application, Serial No. 10 2007 001 194.8, filed Jan. 5, 2007, pursuant to 35 U.S.C. 119(a)-(d), the content of which is incorporated herein by reference in its entirety as if fully set forth herein.

BACKGROUND OF THE INVENTION

The present invention relates, in general, to a servo mechanism for a seat part, especially of a chair, like in an office or work chair Nothing in the following discussion of the state of the art is to be construed as an admission of prior art.

Published U.S. Pat. Appl. No. 2006/0244294 discloses a chair, especially an office or work chair, having a seat part which can be moved on a support frame in longitudinal direction in synchronism to a back rest part which can be reclined from a normal position to several tilted positions. The seat part may also be optionally guided for tilting relative to the support frame. A return device is connected to the free end of a supporting arm of the support frame and connected with the seat part, for transfer of return loads onto the seat part and/or the back rest part. The return device is implemented in the form of a pneumatic spring assembly. Such a pneumatic spring assembly requires however much installation space and thus is relatively expensive. In addition, problems are encountered to produce a counterforce which is as even as possible during movement of the seat part and the back rest part.

It would therefore be desirable and advantageous to address this problem and to obviate other prior art shortcomings.

SUMMARY OF THE INVENTION

According to one aspect of the present invention, a servo mechanism for a seat part arranged on a support frame for travel in a longitudinal direction in synchronism with an adjustment of a back rest part from a normal position to several predetermined reclined positions, includes a scissor-type articulated lever assembly which is connected to the seat part and the support frame and includes several articulated lever elements, and a spring assembly for progressively applying a spring force upon the scissor-type articulated lever assembly such that a relative change in angular disposition between the lever elements applies a substantially constant force upon the seat part in every position of the seat part, whereby a travel distance of the seat part is greater than a spring travel of the spring assembly.

The present invention resolves prior art problems by providing a servo mechanism which is movably coupled to the chair and constructed to generate a counterforce which is as even as possible and can be installed in a substantially space-saving as well as weight-saving and cost-saving manner, despite a progressive behavior of a mechanical spring assembly. As a result, the seat part and the back rest part can be moved evenly during longitudinal displacement in relation to the support frame. The servo mechanism according to the invention is relatively flat in structure as a result of the scissor-shaped articulated lever assembly and can be accommodated in a simple manner underneath the seat part in a space-saving manner. As a result of the spring force application and the substantially constant force transfer upon the seat part, the seat part is able to move substantially jerk-free and evenly as it travels in a longitudinal direction and a person sits on the seat part, and the seat part and/or back rest part can be adjusted by respective body motions into the respectively desired reclined position. The servo mechanism is able to transmit a substantially constant force onto the seat part in every position of the seat part and in all longitudinal displacements of the seat part in relation to the support frame. Thus, operating comfort is improved and a guidance and return of the seat part and/or tiltable back rest part is automatically ensured.

According to another feature of the present invention, the articulated lever assembly may be constructed to tilt the seat part in relation to the support frame.

According to another feature of the present invention, the articulated lever assembly may have at least four articulated lever elements, with a first pair of lever elements connected to one another at a first fulcrum secured to the support frame, and a second pair of lever elements connected to one another at a second fulcrum point secured to the seat part. Suitably, the first and second fulcrums define a connection line, with the articulated lever assembly being constructed in substantial symmetry to the connection line. In this way, the weight of the servo mechanism is distributed substantially evenly across the chair.

According to another feature of the present invention, a support axle may be secured to the support frame, wherein the lever elements of the first pair of lever elements intersect in the first fulcrum and have first and second ends, with the first ends supported on the support axle for rotation about a pivot axis, said spring assembly acting on the first ends of the lever elements of the first pair of lever elements, wherein the second ends of the lever elements of the first pair of lever elements are connected to first ends of the lever elements of the second pair of lever elements, with the lever elements of the second pair of lever elements having second ends being connected in the second fulcrum. As a result, constantly changing relative angular changes of the articulated lever elements of the articulated lever assembly are realized in every position of the seat part in order to ensure a continuous and substantially constant force transfer onto the seat part. In order to realize this substantially constant force transfer onto the seat part, the articulated lever assembly has only mechanical elements which are free of gaseous or liquid media. As a result, the servo mechanism operates reliably with substantially constant properties.

According to another feature of the present invention, the support axle may extend in substantial vertical relationship to the travel distance of the seat part. In this way, the installation space available underneath the seat part can be utilized in a very beneficial manner for the arrangement of the servo mechanism according to the invention.

According to another feature of the present invention, the spring assembly may include two spring elements, one of the spring elements acting on one of the first ends of the lever elements of the first pair of lever elements, and another one of the spring elements acting on the other one of the first ends of the lever elements of the first pair of lever elements. Thus, the spring elements act evenly on the respective ends of the first articulated lever elements to implement a substantially even force application by the spring elements. Suitably, the spring elements are each configured in the form of a helical spring.

According to another feature of the present invention, the spring elements may be compressed as the seat part moves in the longitudinal direction to leave the normal position. Thus, the spring elements operate as energy storing device when the seat part moves longitudinally away from the normal position so that the spring force of the spring elements is able to assist an automatic return of the seat part when the seat part is moved in an opposite direction.

According to another feature of the present invention, the support axle may be connected to a supporting arm which extends in substantial perpendicular relationship to a horizontal leg of the support frame. This results in a substantial centered disposition of the articulated lever assembly in relation to the width dimension of the seat part.

According to another feature of the present invention, a locking device may be provided for limiting a movement of the seat part and/or back rest part when the back rest part is moved into the reclined positions. The locking device permits a forced blockage of a movement of the arrangement of seat part and back rest part in predetermined and pre-selectable positions, if need be, so that the user of the chair is able to optionally adjust and attain pre-selectable adjustment positions in a desired manner.

According to another feature of the present invention, the lever elements may have, at least in part, an arcuate configuration. As a result, an elegant configuration of the articulated lever elements is obtained in the absence of projecting sharp edges, in particular on the sides and ends of the lever elements that possibly pose a risk of injury.

According to another feature of the present invention, the spring assembly may have a variable preset tension to allow adjustment of the spring force to suit different body weights. By allowing variation in the preset tension, respective counterforces can be generated to suit different body weights of persons who use the chair.

A servo mechanism according to the present invention thus permits a substantially jerk-free and even guidance of the seat part and/or back rest part at the respectively different positions. Further, the servo mechanism serves also a return device and includes a spring energy accumulator which serves as energy storage device corresponding to the longitudinal movement of the seat part which, when relaxed, ensures a substantially constant force transfer onto the seat part in every position of the seat part as a result of a respective counter movement. Thus, the servo mechanism combines a spring force application during longitudinal displacement as well as an energy storage function with additional return properties.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
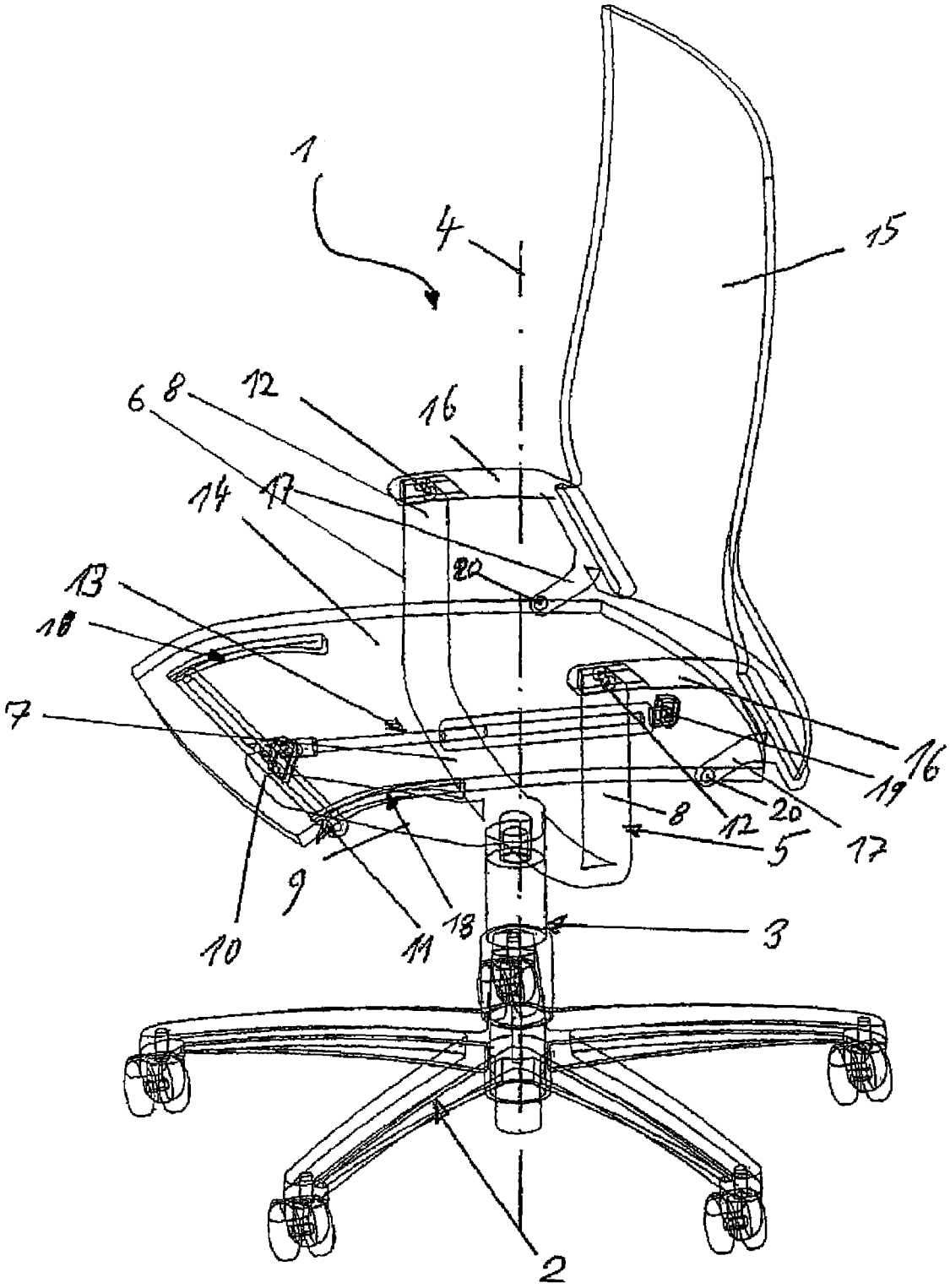
FIG. 1 is a perspective, skeletal illustration of a chair when assembled, with the back rest part in the normal or starting position.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, and in particular to FIG. 1, there is shown, by way of example, a perspective, skeletal illustration of an office chair, generally designated by reference numeral 1, showing a back rest part 15 in the normal or starting position. The office chair 1 includes a central pedestal 2, which is centrally connected via a column-shaped part 3 to a support frame 5. The column-shaped part 3 can, for example, contain a pneumatic spring or the like for height adjustment of the chair 1 to the support frame 5 to allow the chair 1 to rotate about a central axis 4 over the center of the pedestal 2. The support frame 5 is comprised of an essentially U-shaped bracket 6, which has a horizontal leg 7 and at the ends of the horizontal leg 7, has upright leg ends 8. Approximately in the middle of the horizontal leg 7 of the support frame 5, a supporting arm 9 is attached to it, which extends approximately perpendicular to the horizontal leg and, at its cantilevered free end 10, supports a third rotation axis 11. The two upright leg ends 8 support a first rotation axis 12 in a stationary fashion. FIG. 1 further shows a return device 13 embodied, for example, in the form of a spring element, whose one end is firmly attached to the cantilevered free end 10 of the supporting arm 9 and whose other end, spaced apart from this in the horizontal direction, is attached to a seat part 14.

The back rest part 15 of the office chair 1 is attached in the shown nonlimiting example on both sides to a preferably L-shaped pivoting lever 16. In the vicinity of the underside of the back rest part 15, a connecting element 17 is also provided, which is preferably formed in one piece with the L-shaped pivoting lever 16 and serves to attach it to the seat part 14. Although the figures in the drawings show a connecting element 17 on both sides of the back rest part 15, it is, of course, also possible to provide only one central connecting element 17, situated in midsection and designed to cooperate with the seat part 14 in a correspondingly suitable fashion.

The underside of the seat part 14 has a sliding guide 18 on each side in the vicinity of the end of the seat part 14 oriented away from the back rest part 15. Although the drawing shows two sliding guides 18, it is, of course, also possible to provide only a single sliding guide on the seat part 14, in the form of a centrally located device. At a suitable location, the seat part 14 also has a suitable fastener 19 for one end of the return device 13.

From the skeletal, perspective view of the assembled office chair 1, it is clear that in the depicted normal or starting position of the chair 1, the support frame 5 establishes with the upright leg ends 8 in connection with the L-shaped pivoting lever 16 the stationary first rotation axis 12 about which the back rest part 15 can execute a reclining movement. This first rotation axis 12 is situated at a predetermined distance of preferably 50 to 200 mm above the upper edge of the seat part 14, centrally in relation to the pedestal 2. The connecting elements 17 permit the back rest part 15 to move about a second rotation axis 20, which is supported on the seat part 14. The third rotation axis 11, which is provided in a stationary fashion at the cantilevered free end 10 of the supporting arm 9, cooperates with the sliding guides 18 on the underside of the seat part 14. The return device 13, which, on one hand, is attached to the cantilevered free end 10 of the supporting arm 9 and, on the other hand, is attached to the seat part 14, exerts the appropriate forces to execute the returning movements that bring the seat part 14 and the back rest part 15 back to the normal or starting position shown in FIG. 2.

Figure 2:
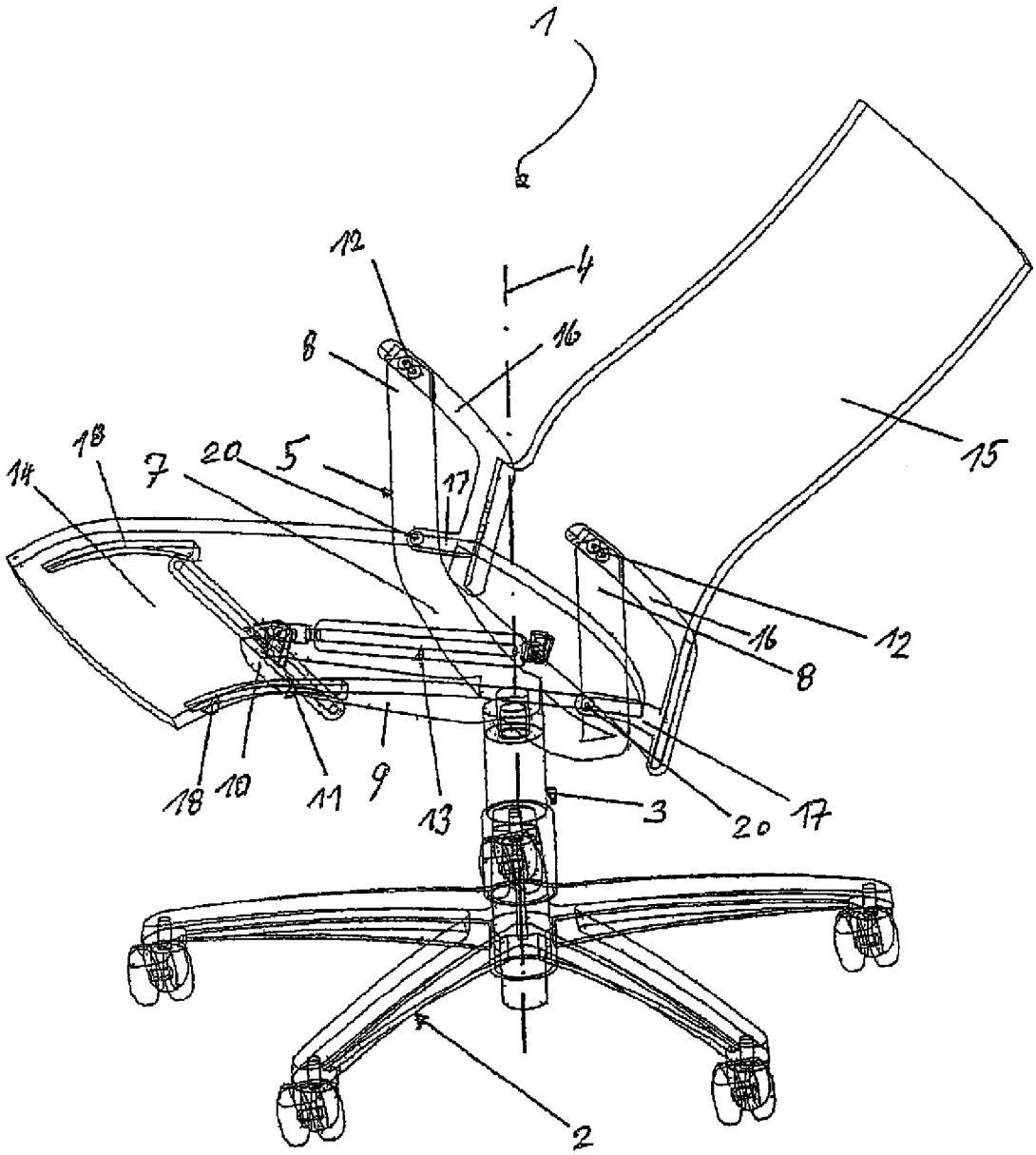
FIG. 2 is a perspective, skeletal view of a chair, in a maximum reclined position of the back rest part.

FIG. 2 is a skeletal perspective overall illustration of the office chair 1 in its maximum reclined position of, for example, 45° or more in relation to the normal position shown in FIG. 1. Even in this maximum reclined position, the first rotation axis 12 is situated on the support frame 5 in stationary fashion, spaced the same predetermined distance apart from the seat part 14 and also centered in relation to the pedestal so that the center of gravity of the person sitting in the chair always remains largely centered over the support frame 5 in all reclined positions of the back rest part 14. For the connecting elements 17 and the cooperation of the second rotation axis 20, synchronous to the reclining movement of the back rest part 15, the seat part 14 is shifted even further in the longitudinal direction and the connecting element 17 assumes an approximately horizontal position or a position in which it lies in the same plane as the seat part 14. This then achieves the end position in terms of the reclined position of the back rest part 15. At the same time, however, the seat part 14 also assumes its greatest possible, preferably upwardly directed tilted position of the seat part 14 through the cooperation of the third rotation axis 11 and the sliding guides 18 on the seat part 14. Of course, tilted positions of the seat part 14 other than this one can also be executed about the third rotation axis 11, which depends on the corresponding embodiment of the sliding guide or sliding guides 18 provided on the seat part 14.

As is also clear from FIG. 2, the spring element of the return device 13 assumes a maximally tensed position and the two ends of the return device 13 are spaced the smallest distance apart from each other, as opposed to the position of the return device 13 in the normal position of the office chair 1 shown in FIG. 1. Even in this maximum reclined position of the back rest part 15 of the office chair 1 shown in FIG. 4, the bodily center of gravity of the person sitting in this office chair 1 remains essentially centered over the pedestal 2, thus achieving the desired stability and safety, and the support of the back rest part 15 for rotation about the first stationary rotation axis 12 remains at the desired, predetermined distance above the upper edge of the seat part 14 so that even in this maximum reclined position of the back rest part 15, the office chair 1 as a whole is operationally safe, stable, and steady. As a result, the person sitting in the office chair 1 assumes a position with a stable center of gravity in every reclined position of the back rest part 15, as well as in every longitudinally shifted and tilted position of the seat part 14 so that even in the relaxation position shown in FIG. 2, the person does not feel uneasy.

Referring now to FIGS. 3 to 7, there are shown various views of a servo mechanism according to the invention, generally designated by reference numeral 29 and movably coupled to the chair 1.

Figure 3:
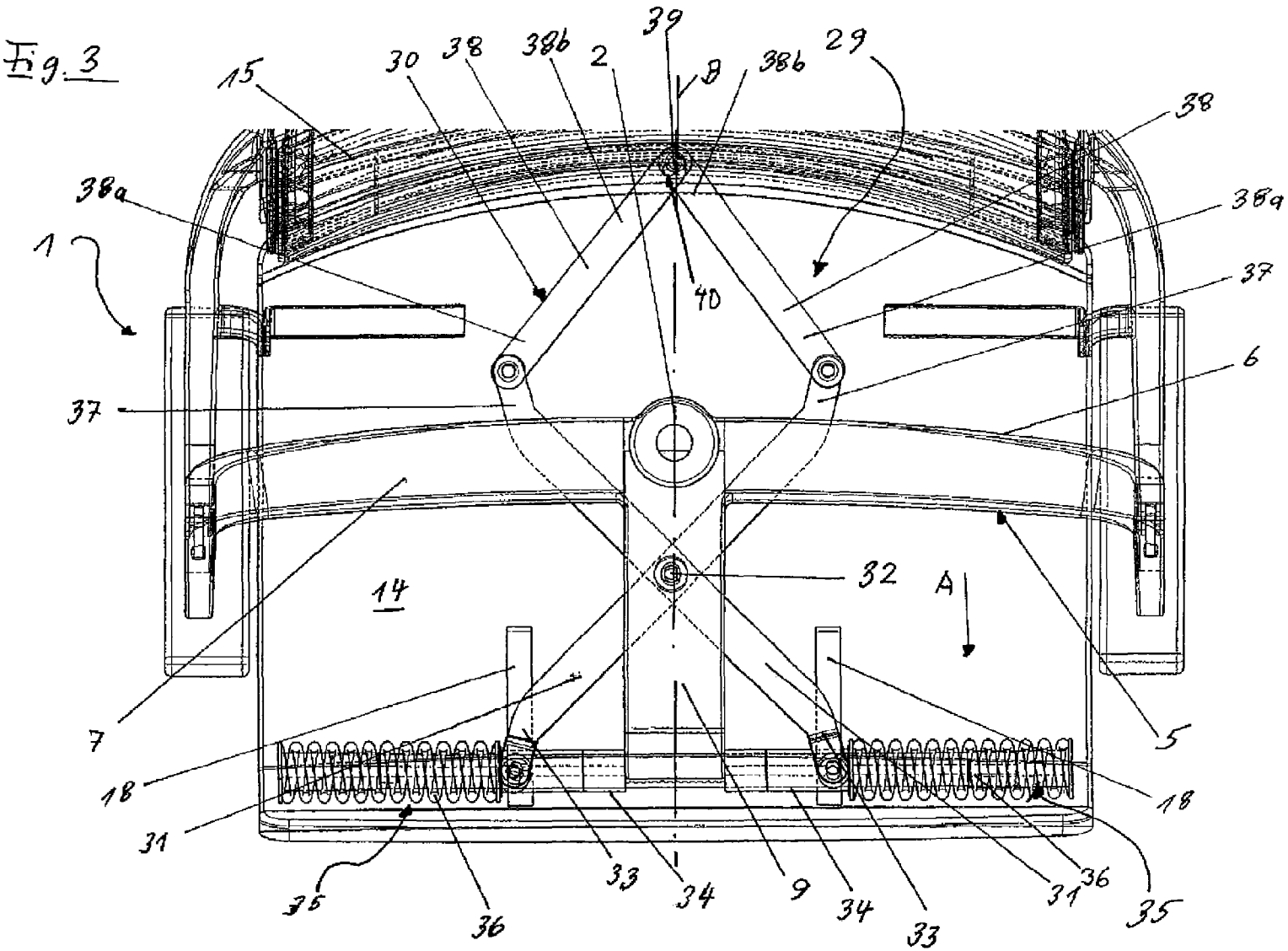
FIG. 3 is a schematic fragmentary illustration for elucidation of a preferred embodiment of a movement-coupled servo mechanism for a seat part according to the invention with association to the normal or starting position, as shown in FIG. 1.
Figure 5:
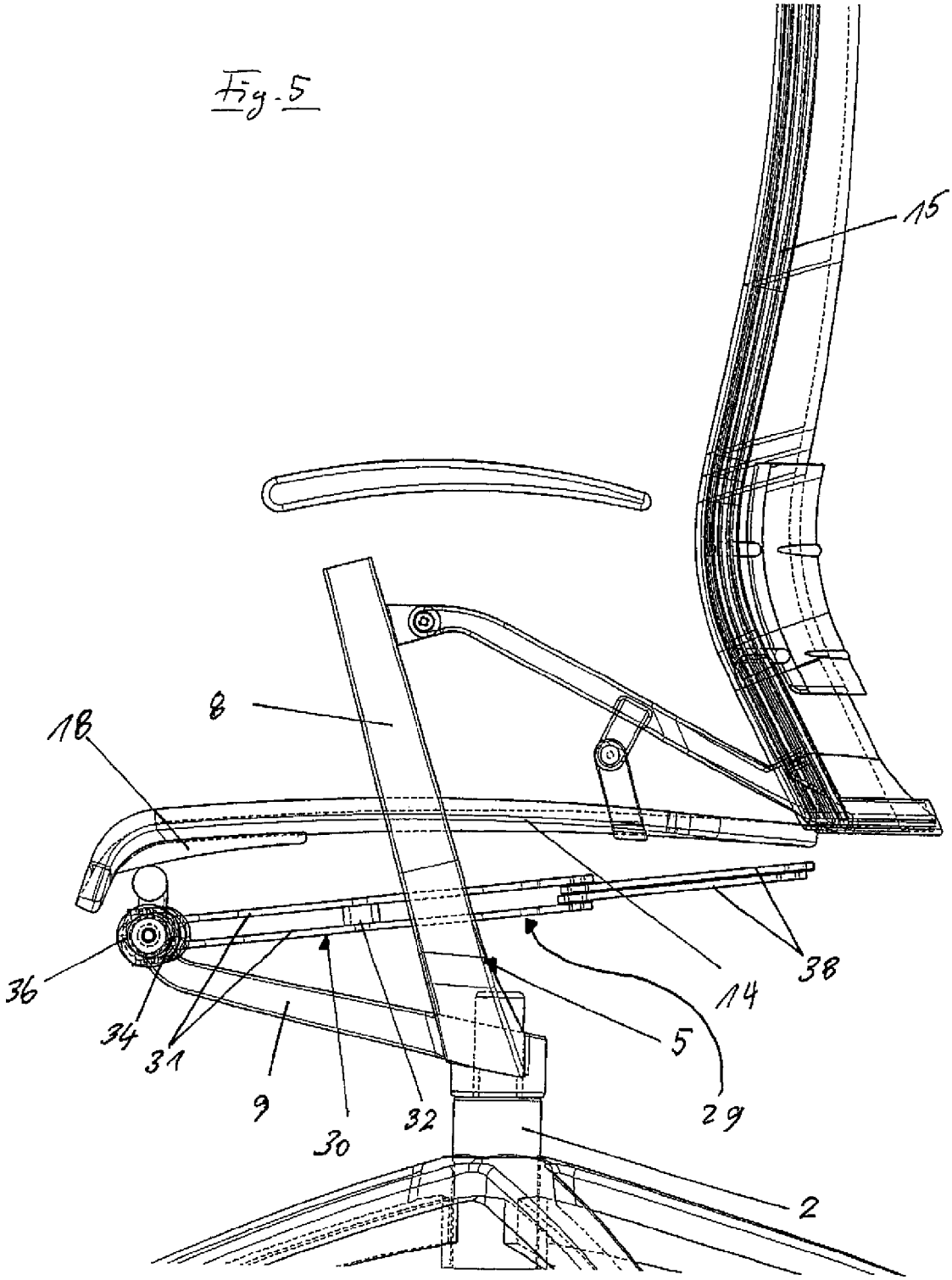
FIG. 5 is a schematic side view for elucidation of the movement-coupled servo mechanism in the normal or starting position of the chair as shown in FIG. 1 and FIG. 3.

FIGS. 3 and 5 show the normal position as well as the starting position of the office chair 1, with the back rest part 15 assuming a substantially vertical basic position and the seat part 14 assuming in synchronism with the back rest part 15 the maximum retracted position. The movement-coupled servo mechanism, generally designated by reference numeral 29 in FIG. 3 and FIG. 5, includes an articulated lever assembly 30 having in the illustrated example two first articulated lever elements 31 and two second articulated lever elements 38, i.e. a total of four articulated lever elements 31, 38. Overall, this articulated lever assembly 30 has a scissor-shaped configuration. The two first articulated lever elements 31 intersect in an intersection point or fulcrum 32 at which the articulated lever elements 31 are rotatably connected with one another. The attachment points of the ends 33 of the articulated lever elements 31 are rotatably supported on the supporting-frame-fixed support axle 34. This support axle 34 is securely fixed to the support frame 5 of the office chair in vicinity of the cantilevered free end 10 of the supporting arm 9 which extends substantially perpendicular to the horizontal leg 7 and is arranged approximately in midsection thereof. Associated to the ends 33 of the articulated lever elements 31 is a spring assembly, generally designated by reference numeral 35, with the ends being acted upon on both sides of the attachment points of the ends 33 on the supporting-frame-fixed support axle 34 by spring elements 36 in the form of helical spring elements of the spring assembly 35. This spring assembly 35 provides a progressive spring force application upon the articulated lever assembly 30. Further, the spring assembly 35 is configured such as to apply counterforces in accordance with a variable preset tension to suit different body weights. As shown schematically in the drawing, threaded sleeves may be associated to the spring elements 36 for allowing, through twisting, a suitable adjustment of the preset tension of the spring elements 36 of the spring assembly 35 for acting on the articulated lever assembly 30 of the servo mechanism 29 so as to be able to take into account different body weights of persons sitting in the chair.

The other ends 37 of the first articulated lever elements 31 are also rotatably and hingedly connected to a respective end 38*a* of two further articulated lever elements 38. The other ends 38*b* of the second articulated lever elements 38 are united at a fulcrum 39 which is securely fixed to the seat part 14 of the office chair 1. The sliding guides 18 can also be seen from FIGS. 3 to 6 for forced guidance of the seat part 14 in relation to the support frame 5 during tiling when shifting longitudinally in synchronism with the back rest part 15. The pedestal 2 is also shown schematically in the figures and configured in the form of a central pedestal and connected to the support frame 5 to allow the latter to rotate about the central center axis 4 (FIGS. 1 and 2) over the center of the pedestal. The longitudinal travel direction of the seat part 14 is indicated schematically by arrow A. The articulated lever assembly 30 is constructed in symmetry to a line B, shown schematically and dashed and extending through the common fulcrum 39 on the seat part 14 and the intersection point 32 of the first articulated lever elements 31.

As can be seen from FIGS. 3 to 6, the support-frame-fixed-support axle 34 for realizing a pivot support of the ends 33 of the articulated lever elements 31 is arranged substantially perpendicular to the longitudinal displacement direction (arrow A) of the seat part 14.

Figure 4:
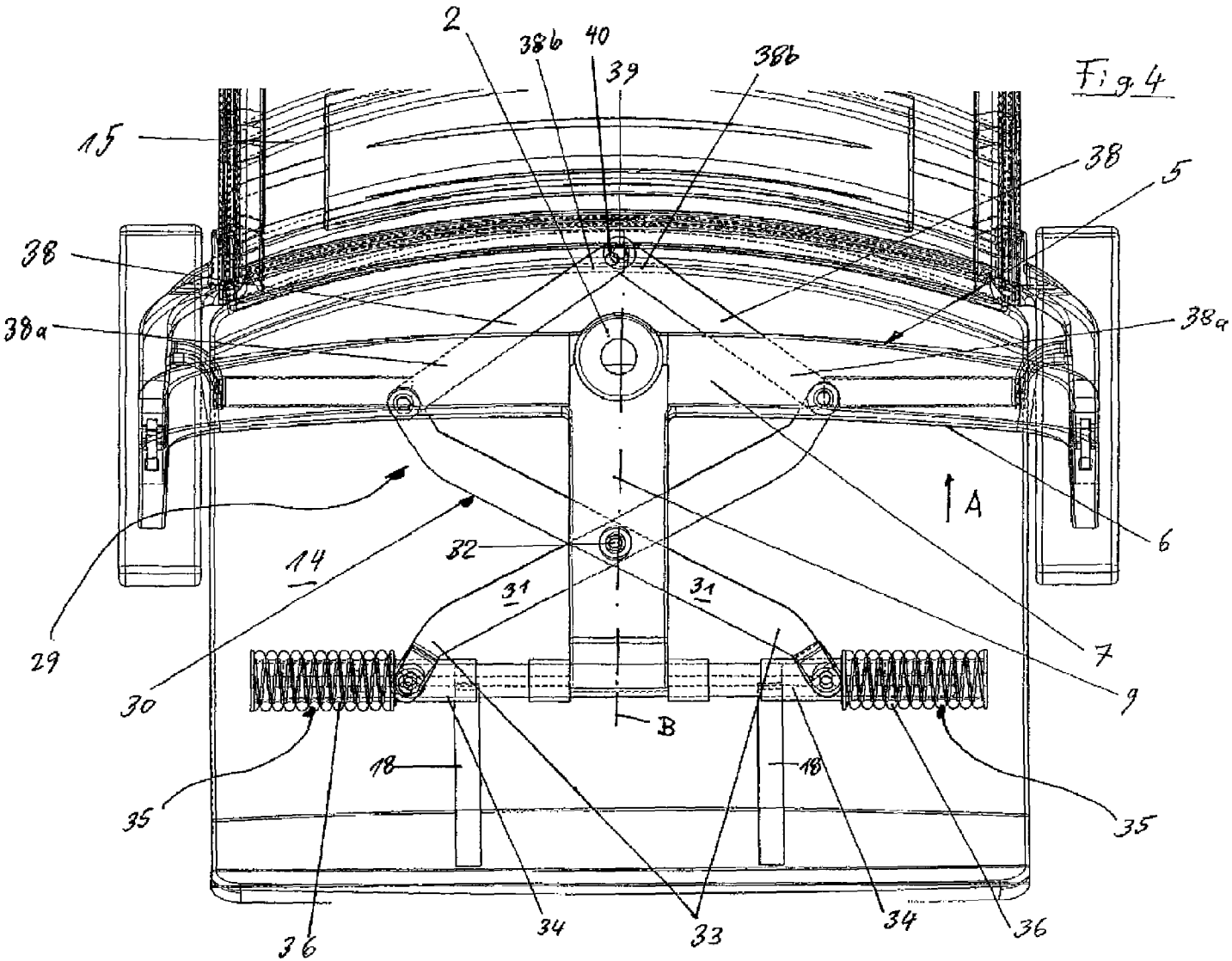
FIG. 4 is a schematic fragmentary illustration for elucidation of the movement-coupled servo mechanism for a seat part according to the invention with association to the maximum reclined position of the back rest part and the maximum longitudinal displacement of the seat part, as shown in FIG. 2.
Figure 6:
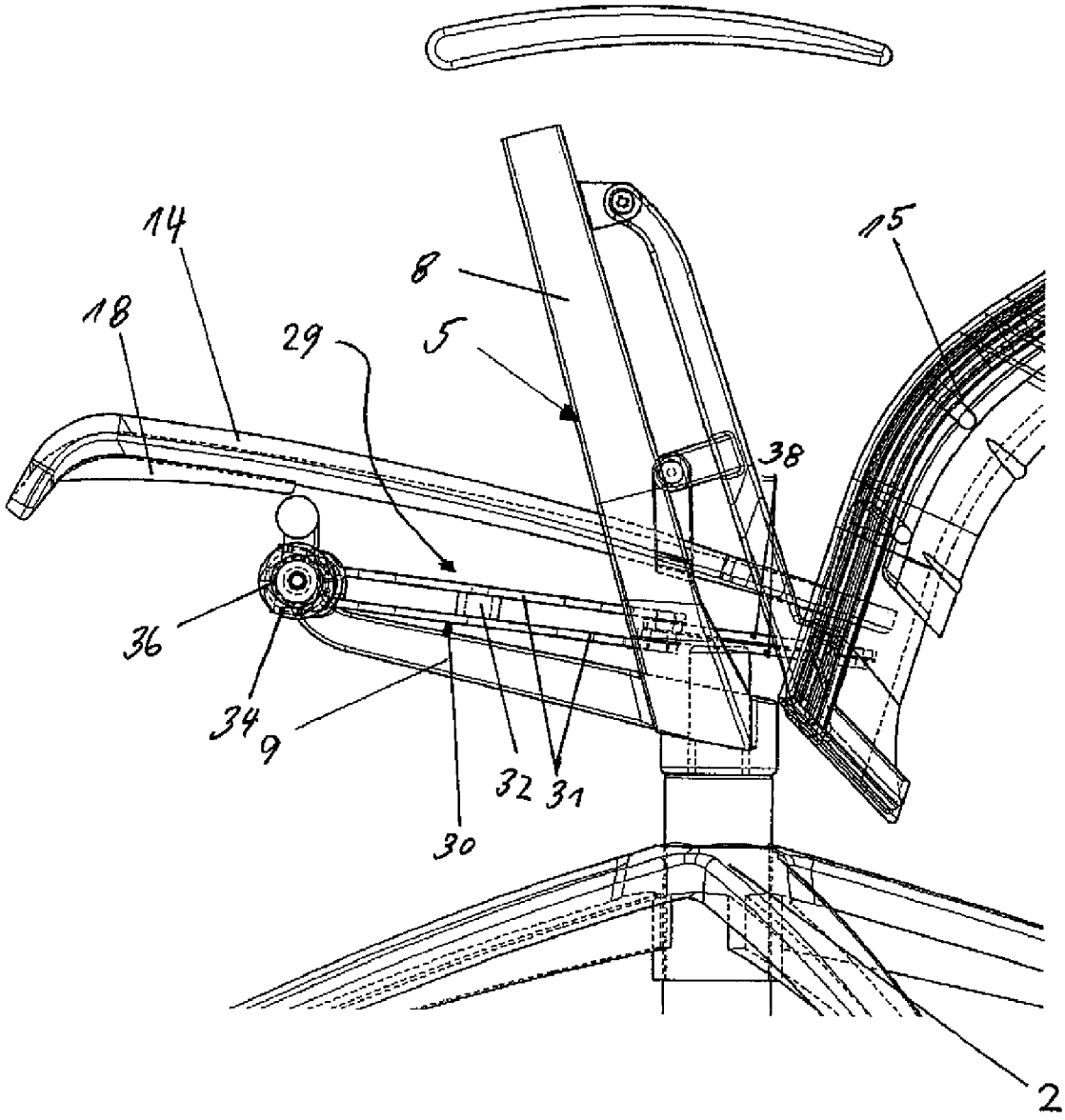
FIG. 6 is a side view corresponding to FIG. 5 for elucidation of the movement-coupled servo mechanism with association of the maximum reclined position of back rest part and seat part of the chair as shown in FIG. 2.

FIGS. 4 and 6 show the servo mechanism 29 in a position in which the back rest part 15, in correspondence to FIG. 6 and FIG. 2, assumes its maximum reclined position and the seat part 14, coupled in synchronism therewith, assumes the position that is displaced furthest in longitudinal direction. As can be seen by a comparison of FIG. 3 and FIG. 4, the spring elements 36 of the spring assembly 35 are compressed and squeezed together in the position of FIG. 4 so as to allow a spring force application of the servo mechanism 39 in return direction, when the back rest part 15 and/or the seat part 14 move accordingly in the direction of the normal position because the spring assembly 35 forms an energy storage device which generates a respective resultant force application upon the articulated lever assembly 30 as the spring elements 36 relax when the servo mechanism 29 moves from the position of FIG. 3 to the position of FIG. 4. In the position of the articulated lever assembly 30 shown in FIG. 4, the distance between the intersection point 32 of the first articulated lever elements 31 and the common fulcrum 39 on the seat part 14 shortens in accordance with the longitudinal displacement of the seat part 14 in longitudinal travel direction A. Also the spring elements 36 of the spring assembly 35 have been shortened by the compression. As can be seen by a comparison of FIG. 3 and FIG. 4, the seat part 14 covers a relatively long distance during longitudinal displacement while the spring travel of the spring elements 39 of the spring assembly 35 is relatively short in relation thereto. The scissor-shaped articulated lever assembly 30 of the servo mechanism 29 which includes several articulated lever elements 31, 38 is constructed in particular such that a substantially constant force transfer is realized upon the seat part 14 in every position of the seat part 14 during progressive spring force application by the spring elements 36 of the spring assembly 35. This fact can be attributed to the relative angular changes of the articulated lever elements 31, 38 relative to one another.

A locking device 40 in the form of a slotted guide may be provided for limiting a movement of the seat part 14 and/or back rest part 15 in predetermined angles for the reclined positions of the back rest part. A suitable locking device may, for example, be associated to the common fulcrum, as shown by way of example in FIGS. 3 and 4.

Figure 7:
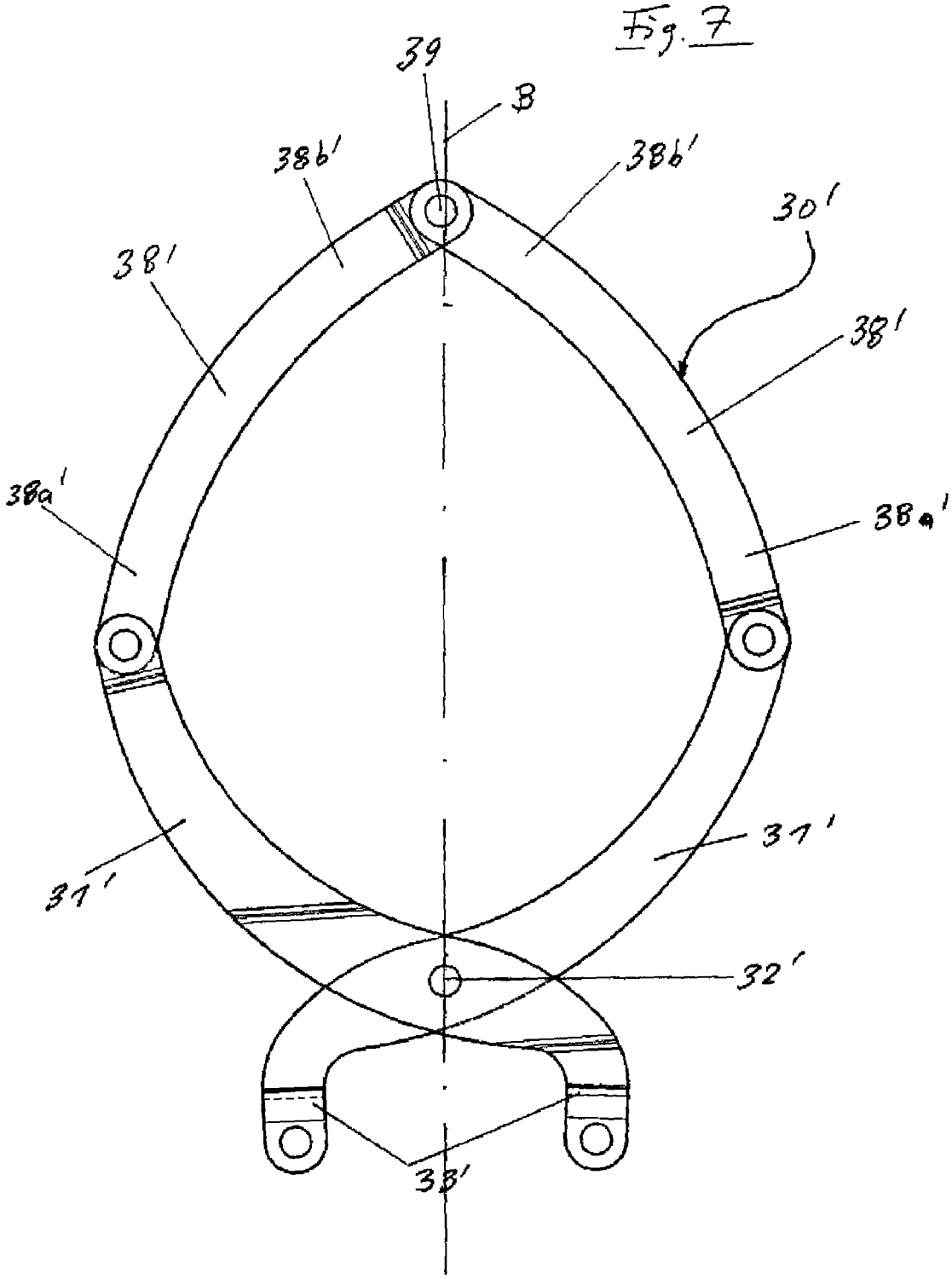
FIG. 7 is a schematic plan view of a variation of the articulated lever assembly of the movement-coupled servo mechanism for a seat part in accordance with the invention.

FIG. 7 shows a schematic plan view of a variation of the articulated lever assembly 30' having first articulated lever elements 31' and second articulated lever elements 38'. The difference to the afore-shown articulated lever assembly 30 resides in the arcuate configuration, at least in part, of the articulated lever elements 31' and 38' of the articulated lever assembly 30' to prevent projecting edges and to impart the articulated lever assembly 30' an elegant look.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. An adjustment mechanism for a seat part swingably connected to a back rest part and arranged on a support frame for travel in a longitudinal direction in synchronism with an adjustment of the back rest part from a normal position to several predetermined reclined positions, said adjustment mechanism comprising:

a lever assembly including a first pair of levers having first and second ends, with the first ends pivotally connected to the seat part, and a second pair of levers which intersect one another and have first and second ends, with the first ends rotatably connected to the support frame and the second ends pivotally connected to the second ends of the first air of levers; and a spring assembly for progressively applying a spring force upon the the first ends of the second pair of levers such that a relative change in angular disposition between the levers of the first and second pairs of levers applies a substantially constant force upon the seat part in every position of the seat part, whereby a travel distance of the seat part is greater than a spring travel of the spring assembly.

2. The adjustment mechanism of claim 1, wherein the second pair of levers intersect at a first fulcrum secured to the support frame, and the first ends of the first pair of levers are connected to one another at a second fulcrum point secured to the seat part.

3. The adjustment mechanism of claim 2, wherein the first and second fulcrums define a connection line, said lever assembly being constructed in substantial symmetry to the connection line.

4. The adjustment mechanism of claim 2, further comprising a support axle secured to the support frame, wherein the first ends of the second pair of levers are supported on the support axle for rotation about a pivot axis.

5. The adjustment mechanism of claim 4, wherein the support axle extends in substantial vertical relationship to the travel distance of the seat part.

6. The adjustment mechanism of claim 4, wherein the spring assembly includes two spring elements, one of the spring elements acting on one of the first ends of the levers of the second pair of levers, and another one of the spring elements acting on the other one of the first ends of levers of the second pair of levers.

7. The adjustment mechanism of claim 6, wherein the spring elements are helical springs.

8. The adjustment mechanism of claim 6, wherein the spring elements are compressed as the seat part moves in the longitudinal direction to leave the normal position.

9. The adjustment mechanism of claim 4, wherein the support axle is connected to a supporting arm which extends in substantial perpendicular relationship to a horizontal leg of the support frame.

10. The adjustment mechanism of claim 2, wherein the levers of the first and second pairs of levers have, at least in part, an arcuate configuration.

11. The adjustment mechanism of claim 1, further comprising a locking device for limiting a movement of the seat part and/or back rest part when the back rest part is moved into the reclined positions.

12. The adjustment mechanism of claim 1, wherein the spring assembly has a variable preset tension to allow adjustment of the spring force to suit different body weights.

* * * * *